US006001784A

United States Patent [19]

Trivett

[11] Patent Number: 6,001,784

[45] Date of Patent: Dec. 14, 1999

[54] HIGH MELT POINT SOLID FILM PRELUBE EMULSION FOR USE ON ALUMINUM AND OTHER METALS

[75] Inventor: Robert L. Trivett, Aurora, Ill.

[73] Assignee: Nalco Chemical Company, Naperville, Ill.

[21] Appl. No.: 08/132,080

[22] Filed: Oct. 5, 1993

[51] Int. Cl.[6] ..... C10M 173/00; B21B 45/02

[52] U.S. Cl. ..... 508/450; 508/507; 508/555; 72/42

[58] Field of Search ..... 252/49.5; 72/42; 508/450

[56] References Cited

U.S. PATENT DOCUMENTS

| | | | |
|---|---|---|---|
| 3,419,494 | 12/1968 | Teeter et al. | 252/49.5 |
| 3,676,344 | 7/1972 | Kuceski | 252/49.5 |
| 3,933,661 | 1/1976 | Abrams et al. | 252/49.5 |
| 4,439,344 | 3/1984 | Albanese | 252/49.5 |
| 4,846,986 | 7/1989 | Trivett | 252/49.5 |
| 5,091,100 | 2/1992 | Trivett | 252/49.5 |

OTHER PUBLICATIONS

Literature Search Report No. 4277, Sep. 2, 1992, "Ductility Testing (Especially Olsen Test) on Aluminum for Evaluating Lubrication Characteristics of Forming Lubricants".

Literature Search Report No. 3988, Feb. 6, 1992, "Lubricants Used For Stamping and Forming of Aluminum".

*Primary Examiner*—Ellen M. McAvoy

*Attorney, Agent, or Firm*—Kelly L. Cummings; Thomas M. Breininger

[57] ABSTRACT

A solid film prelubricant composition comprising a fatty acid amide-in-water emulsion including from about 0.10 to about 10.0 wgt % of a hydroxystearamide wax selected from the group consisting of N-(2-hydroxyethyl)-12-hydroxystearamide and N,N'-ethylene-bishydroxystearamide; from about 0.2 to about 7 wgt % emulsifier having an HLB number of at least 8; and from about 85 to about 95 wgt % water.

7 Claims, No Drawings

HIGH MELT POINT SOLID FILM PRELUBE EMULSION FOR USE ON ALUMINUM AND OTHER METALS

FIELD OF THE INVENTION

The present invention is generally related to compositions for lubricating metal. In particular, the present invention relates to solid film prelubricant compositions and methods of lubricating metal with the compositions, specifically hydroxystearamide wax-in-water solid film prelube emulsions for aluminum, wherein the compositions result in a solid film lubricant layer possessing a high melt point.

BACKGROUND OF THE INVENTION

Solid film prelubricants are used in several metalworking operations including stamping, drawing, forging, blanking, bending, rolling, cutting, grinding, punching, sawing, hobbing, reaming, spinning, extruding, trepanning, coining, swagging and the like. Solid film prelube emulsion lubricants improve the production of formed parts for the automotive, appliance, food container and general manufacturing industries. In these industries, sheet metal is formed into specific shapes by the use of mechanical presses. Such general metal-working operations can be further categorized into stamping and drawing.

Stamping includes all forming operations where parts are formed from sheet metal without a change in the gauge or thickness of the sheet metal. Drawing defines all forming operations where there is a change or reduction in the gauge or thickness of the sheet metal. Shallow drawing is the forming of a cup or shape no deeper than one-half its diameter with only small reductions in metal gauge or thickness. The forming of a cup or shape deeper than half its diameter with substantial reductions in metal thickness or gauge is known as deep drawing. Formed parts for the automotive, appliance, food container and general manufacturing industries may be produced by one or a combination of these stamping and drawing operations.

Heat generated during the course of such operations can adversely affect the outcome of the operations, changing the metallurgical properties of the sheet metal and tooling, resulting in undesirable effects such as staining and oxidation of the metal. During typical metal-forming operations, temperatures attained can be as high as 180–190° F. which temperatures are higher than the melt points of prior art solid film prelubricants, such as those described in U.S. Pat. Nos. 5,091,100 and 4,846,986, as well as co-pending application Ser. No. 07/906,167, the teachings of which are herein explicitly incorporated by reference. Reducing the coefficient of friction for a specific forming process serves to minimize heat generated during the forming operations, reduce power requirements, reduce tool wear and eliminate blocking or adhesion between the sheet metal and tooling during the forming operations, transit and storage of the formed parts. Forming lubricants, especially solid film prelube emulsions, reduce the friction that occurs between the metal being formed and the tooling employed for the forming operation, and between metal pieces during storage, handling and forming. However, the beneficial effects of the use of prelubricants are significantly diminished in applications where the operating temperature of the forming apparatus-exceeds the melt point of the solid film prelube, resulting in degradation of the lubricating effect of the composition. Consequently, there exists a need for a solid film prelubricant that possesses a sufficiently high melt point, preferably in excess of 200° F., that will enable the composition to be used in forming operations generating high temperatures. More importantly, it is desirous that such a prelubricant composition, forming a high melt point solid film prelube layer on treated metal, retain the desirable performance characteristics, such as lubrication, cleanability, metal compatibility, etc., needed for successful application.

Prior to the development and use of prelubes, a single composition could not provide both adequate lubrication for a metalworking forming process as well as corrosion protection for the metals involved. According to prior art practices, metal coils would arrive at a processing site, such as a stamping plant, coated with a rust preventative oil to protect against corrosion. Between the steps of blanking and the actual forming operation, the rust preventative oil was removed by a cleaning operation using an alkaline cleaner, solvent cleaner or blank wash oil. A hydrocarbon oil-based forming lubricant would then be applied to the sheet metal before the stamping or drawing operation. In addition to requiring separate corrosion resistance and lubrication treatments, the removal of the corrosion inhibitor would also create a significant volume of waste fluids generated during the cleaning process. These waste fluids would then present additional problems of handling, storage and disposal due to their potentially hazardous character.

In the last decade, this tedious process of using separate rust preventative oils and drawing lubricants has been replaced by the use of a single prelube composition. Prelubes thus function as both a corrosion preventative and a forming lubricant. Either hydrocarbon oil-based or solid film prelubes are applied at the sheet metal mill during either temper rolling or inspection. Thus, no modifications to physical equipment or processes are needed within the sheet metal mill to use prelubes, as the application of prelubes merely replaces the application of rust preventative oils. Advantages are obvious, in that prelube compositions do not need to be removed from the sheet metal until after the blanking and forming operations. Thus, the use of such prelube compositions eliminates the cumbersome, multistep process of applying and removing the combination of rust preventative oils and forming lubricants before forming operations. There exists a continuing need for compositions which both adequately prevent corrosion and provide lubrication to ferrous and nonferrous metals during forming operations.

The advantages obtained by the efficiency of using a prelube, however, would be diminished or nullified if unusual methods were necessary to remove the lubricant from the final product. Some substances with lubricating properties, for instance wax films, cannot be easily removed with alkaline cleaners and thus their use entails a serious detrimental effect on the efficiency of overall operations.

In addition to lubrication and corrosion protection, a prelube composition must be removable, nonstaining to the metal and compatible with other chemicals used in producing formed metal parts. In order to prevent interference with all future processing operations after forming, all traces of the prelube composition must be removed from the metal surface of the formed part. In most industries relying on formed metal parts, powdered or aqueous alkaline and acid cleaners are typically utilized for removing lubricant compositions. Such cleaner compositions are water soluble at the recommended dilutions and are strongly alkaline or acidic in nature in order to effectively remove all traces of processing lubricants from a wide variety of metal substrates. Many prelube compositions, especially hydrocarbon oil-based systems, contain chemical additives that cannot be easily removed with such cleaners, thereby having a detrimental effect on all future processing operations and even limiting potential applications for the formed metal parts. A need exists for compositions with improved cleanability from metal substrates as compared to the other prelubes used on such substrates, including hydrocarbon oil-based and dry film lubricant compositions.

Metal coils coated with prelube compositions can be stored for indefinite periods of time before being stamped or drawn into parts. Many chemical constituents of such prelube compositions can oxidize to varying degrees during storage. Oxidation byproducts from hydrocarbon oil components can adversely affect metal surfaces causing staining, discoloration, etching or pitting of the outer atomic layers of the metal strip. Automotive, appliance, food container and general manufacturing industries require prelube compositions that will protect metal substrates against conditions of oxidation and will not cause contact staining during storage.

Prelubes must also be compatible with other processing chemicals and operations following forming operations. Many formed parts often have severe bends or angles formed during fabrication operations. These bends and angles can create flanges, seams or other tight radii where prelube compositions can become entrapped. Even with normal exposure to alkaline cleaners, trace amounts of prelube can remain out of reach within these intricate areas. Although prelube compositions may be effectively removed from exposed part surfaces, trace amounts of prelube remaining on the formed parts can be volatilized or otherwise released during subsequent processing operations potentially contaminating those processes. This situation necessitates that such prelube compositions, especially solid film prelube compositions, be compatible with cathodic electrocoat paint primers, adhesives used to bond structural components together, as well as any type of welding or post welding operations. In additions, for applications where the formed metal is used in the manufacture of beverage or other food containers, whatever trace amounts of lubricant remain after cleaning must be compatible with the food or beverage to be stored in the containers.

The prelubes commonly used in manufacturing industries such as the automotive industry are hydrocarbon-based compositions containing sulfurized or waxy components, liquid at ambient room temperature. These compositions tend to drain off the metal surfaces, creating maintenance problems, and further tend to be or become unevenly distributed on the metal surfaces due to capillary forces. The properties of rust prevention and drawing assistance both depend in significant part on uniformity of the lubricant film. Such tendency to puddle on the metal surface diminishes a lubricant's potential in providing protection from rust and in facilitating the stamping or drawing operations. Thus, these industries desire a prelube that provides lubricant film uniformity and film strength undiminished during shipping and storage periods, Further, film strength is a particularly significant property for facilitating drawing operations; a lubricant having high film strength will permit more severe draws to be made. The prelube compositions of the present invention provide a uniform, homogenous and consistent film morphology and structure on a metal substrate.

Often, prior art prelube compositions must be applied at coverage rates up to 1000–2000 mg/ft$^2$ in some applications to provide the required performance. Many industries desire prelube compositions that can offer effective performance at lower coating weights thereby improving overall cost efficiency of the forming operation. An advantage of the compositions of the present invention is effective performance on metal substrates at lower coating weights (between 20 and 500 mg/ft$^2$), which substantially improves forming lubricant cost performance.

All prelube compositions must lend themselves to improving housekeeping and cleanliness conditions at the mill and at the manufacturing plant. Often, hydrocarbon oil-based lubricants and some solid film prelubes can leak onto machine and work surfaces or volatilize into the atmosphere creating a hazardous work environment. Prelubes can often create irritation or dermatitis among employees exposed to the compositions. The compositions can also contaminate floor trenches around forming presses, thereby often reaching waste treatment streams. The prelube compositions of the present invention are non-hazardous and do not contaminate the work environment.

A prelube composition must be compatible with waste treatment processes and chemicals. Prelube compositions entering waste streams must have minimal to no effect on the streams and be classified as waste treatable. The prelube compositions of the present invention are compatible with existing waste treatment schemes because they are treatable by conventional waste treating processes and enter the waste treating processes at significantly lower levels.

DETAILED DESCRIPTION OF THE INVENTION

The present invention contemplates a prelubricant composition which provides a solid film lubricating layer when applied to metal surfaces, wherein the solid film layer possesses a high melt point, preferably in excess of 200° F. The prelubricant composition of the present invention provides such a high melt point solid film layer that also retains the desirable operating characteristics of prior art compositions of significantly lower melt point. In addition to providing superior lubrication compatible with forming operations at elevated temperatures, the prelubricant provides corrosion protection, ease of application with roll-coating equipment, cleanability, and improved waste treatability. Particularly important in applications such as aluminum beverage containers, the cleanability of the prelubricant composition of the present invention makes it possible for treated aluminum surfaces, after cleaning, to pass flavor tests where results are measured in terms of linoleic acid levels of residues on the treated metal surface. Housekeeping problems form oily surfaces and oily mists, and the release of volatile hydrocarbon solvents into the environment during application and use, commonly associated with prior art lubrication methods and compositions, are also eliminated by use of the lubricant composition of the present invention.

The prelubricant composition of the present invention comprises an hydroxystearamide wax-in-water emulsion, wherein the emulsion comprises from about 0.10 to about 10.0 wgt % hydroxystearamide wax, from about 0.20 to about 7.0 wgt. % emulsifier having an HLB number of at least 8, more specifically with an HLB number between 8 and 10 HLB, and from about 85 to about 95 wgt % deionized water. Preferably, the solid film prelubricant may include additional components such as from about 1 to about 10 wgt % imidazoline corrosion inhibitor, from about 0.5 to about 5.0 wgt % ethylene-acrylic acid copolymer, from about 0.01 to about 1.0 wgt % antioxidant, from about 0.5 to 5.0 wgt % of an adipic acid ester to enhance surface film formation, and from about 0.01 to about 1.0 wgt % antimicrobial agent. Especially preferred hydroxystearamide waxes for the composition of the present invention are N-(hydroxyethyl)-12-hydroxystearamide (Paracin 220™, CasChem) and N,N'-ethylene-bishydroxystearamide (Paracin 285™, CasChem). Selected properties of these hydroxystearamide waxes are summarized below. An important aspect of the compositions of the present invention is the inclusion of such hydroxystearamide waxes which are responsible for attaining the high melt points of the dry film prelubes deposited on metal substrates by application of the compositions. As will be recognized by one of slill in the appropriate art, successful (stable) emulsification of such waxes has heretofore been impossible to attain.

| | Paricin 220 | Paricin 285 |
|---|---|---|
| Acid Value | 1 | 4 |
| Iodine Value | 4 | 4 |
| Hydroxyl Value | 300 | 165 |
| Saponification Value | 14 | 14 |
| Specific Gravity | 1.05 | 1.02 |
| Penetration Hardness | 1 | 1 |
| Melting Point (° C.) | 104 | 140 |

Hydrophile-lipophile balance (HLB) represents the proportion of hydrophile (water loving) to lipophilic (oil loving) groups within a molecule with a number assigned to a surfactant that represents that proportion. Water-in-oil emulsions typically utilize surfactants with an HLB from 2–8 as emulsifiers. Oil-in-water emulsions typically utilize surfactants with an HLB from 8 to 18 as emulsifiers. An oil-in-water or wax-in-water emulsion would utilize water as the external or continuous phase and the oil or wax chemistry as the internal or discontinuous phase of the emulsion.

It is also contemplated that additional ingredients may be incorporated into the compositions of the present invention to improve specific properties of the lubricant without degradation of the performance characteristics of the resulting solid film lubricant layer resulting on treated metal substrates. For example, the prelubricant composition may also contain a tridecyl stearate ester, available Uniflex 188™, obtained from Union Camp Corporation, incorporated into the composition for the purpose of enhancing surface film formation and high temperature lubrication from about 0.5 to 5.0 wgt %. Uniflex 188 is the preferred tridecyl stearate having a specific gravity of 0.86, acid value of 1.5, saponification value of 124 and an iodine value of only 0.5.

The prelubricant composition may also contain other types of esters, which when incorporated into the composition, would enhance high temperature lubrication performance on both ferrous and non-ferrous metals. Preferred esters would include butyl stearate, isobutyl stearate, citric acid esters and adipic acid esters. The most preferred adipic acid ester would be Smithol 50, manufactured by Werner G. Smith, Inc. Smithol 50 is the preferred adipic acid ester having a specific gravity of 0.895, viscosity of 120–155 SSU at 100° F., acid value of 8.0 maximum and saponification value of 145.

A preferred embodiment of the present invention is a prelubricant composition comprising from about 2.0 to about 6.0 wgt % emulsifier having an HLB number of at least 8, and from about 87 to about 93 wgt % deionized water. Preferably, the solid film prelubricant can additionally include from about 1 to about 2 wgt % imidazoline corrosion inhibitor, from about 0.5 to about 4.0 wgt % ethylene-acrylic acid copolymer, from about 0.01 to about 0.5 wgt % antioxidant, 0.5 to 5.0 wgt % ester, and from about 0.01 to about 0.5 wgt % antimicrobial agent.

An emulsifier having an HLB of from 8 to 18 is preferred for enabling the emulsions of this invention. The preferred emulsifier is the ester reaction product formed from double-pressed stearic acid and an alkanolamine. In preferred embodiments, the stearic acid is double pressed stearic acid with a molecular weight of 285, an approximate acid value of 210, with accompanying saponification value of 211, and titer value of 120° F. The alkanolamine of the present invention is selected from the group consisting of 2-amino-2-methyl-1-propanol (AMP™), 2-amino-1-butanol, the mono-, di-, and tri-isopropanolamines and ethanolamines, 2-amino-2-methyl-1,3-propanediol, 2-amino-2-ethyl-1,3-propanediol (AMPD™), 2-amino-2-hydroxymethyl-1,3-propanediol (AEPD™), and N-alkyl and N,N-dialkyl derivatives thereof. AMP™, AMP-95™, AMP-90™, AEPF™, AMPD™, and TRIS AMINO® are manufactured by ANGUS Chemical Company. The preferred alkanolamine is 2-amino-2-methyl-1- propanol having a specific gravity of 0.942, neutralization value of 95, and flash point of 182° F. (TCC).

It is noteworthy that the ester reaction product formed from such esterification reactions also functions not only as an emulsifier, but also as a corrosion inhibitor and source of reserve alkalinity in both the hydroxystearamide wax-in-water emulsion composition and in the resulting dried film prelubricant layer. The excess stearic acid remaining from the reaction functions also as a corrosion inhibitor and boundary lubricant in the dried film.

The lubricant according to the present invention also contains from 0.1 to 3.0 weight percent of a polymeric composition comprised of an ethylene homopolymer, a polymer derived from the polymerization of ethylene and ethylenically unsaturated carboxylic monomers, oxidized derivatives of such ethylene polymers, and mixtures thereof These polymers promote uniform wetting of the hydroxystearamide wax-in-water emulsion and promote adhesion of the dried coating to the metal substrate. These polymers also enhance the hardness properties of the dried coating on the metal substrate.

A preferred polymer component of the composition of the present invention will have the following general formula:

$$CH_2(CH_2)_m(CH_2CHCOOH)_n$$

wherein the integers m and n are selected so that the molecular weight of the copolymer is preferably in excess of 2,000. Suitable ethylene copolymers would have a Mettler drop point (ASTM D03104) of 92 to 108° C.; hardness (ASTM D-5) of 2.0 to 11.5 dmm; a density (ASTM D1505) of about 0.90 to 0.95 g/cc; a Brookfield viscosity of 500 to 650 cps at 140° C.; and an acid number of 40–120 mg KOH/g. Suitable polymers would also have a melting point of from 85° to 115° C. (185° to 239° F.). A particularly preferred polymer is an ethylene based polymer comprised of ethylene and acrylic acid monomers, with a melting point of from 90° to 110° C. A particularly useful ethylene/acrylic acid copolymer is one having a hardness of from about 12 to 16, a melting point of 90° to 100° C. and an acid number of from about 110 to 130. Suitable polymers are obtainable from Allied signal, sold as A-C 540® and A-C 5120™.

The lubricant composition of the present invention also can contain from about 0.1 to about 5 wgt % of a composition comprised of a blend of L-aspartic acid diester and oleic acid imidazoline, more specifically L-aspartic acid, N-(3-carboxy-1-oxo-2-propenyl)-N-octadecyl-bis(2-methyl propyl) ester, and 1-H-imidazole-1-ethanol, 2-(heptadecenyl)-4,5-dihydro. Such composition has an acid value of 50–100, an alkali value of 5–50, and is a fluid composition at ambient temperature. Such a composition provides not only the necessary corrosion protection required for the dried film on the metal substrate, but also acts in conjunction with the stearic acid/alkanolamine ester as a secondary emulsifier to form the emulsion composition of the present invention. Furthermore, the imidazoline also functions as a surfactant which improves cleanability of the solid film coating when exposed to aqueous alkaline and acid cleaners at 105° to 125° F. The preferred imidazoline lubricant is the aspartic acid diester, 1-(2-hydroxyethyl)-2-heptadecenyl imidazoline. This imidazoline is primarily a mixture of the diester of L-aspartic acid and an imidazoline based on the reaction between oleic acid and aminoethyl ethanolamine. This imidazoline composition has an acid value of 50 to 100 and an alkali value of 5 to 50, and is a fluid at ambient temperature. Preferably, it has an acid value of 65 to 75 and an alkali value of 30 to 40. The preferred imidazoline blend is Monacor 39 manufactured by Mona Industries, Inc.

The lubricant may also contain from 0.1 to 2.0 weight percent of a hindered phenol antioxidant, preferably 2,6-di-tertiary-butyl-para-cresol, with a melting point of 147° F. Such an antioxidant is compatible with all components of the lubricant and provides an additional level of corrosion protection by reducing or eliminating the potential for lubricant staining of ferrous and non-ferrous metals. The lubricant may also contain an antimicrobial agent such as 1-(3-chloroallyl)-3,5,7-triazo-1-1-azoniaadamantane chloride in an amount of 0.05 to 1.0 wgt %. The preferred biocide would be Dowicil 75 manufactured by Dow Chemical Corporation.

The lubricant, according to the present invention, is an hydroxystearamide wax-in-water emulsion, a solid film prelube emulsion type of coating particularly useful in metalworking operations and particularly advantageous for stamping and drawing operations for applications in the automotive, appliance, food container and general manufacturing industries. The lubricant provides a uniform film that is retained during handling and working to a degree not achievable with an oil-based lubricant. This is because, once the water evaporates from the emulsion, only a solid film lubricant remains on the coated metal substrate. Due to the uniformity and strength of the film coating provided by the lubricant, more severe draws can be made in metal working operations. Most draws can be made using a coating thickness (weight of lubricant per unit area basis) that is one-tenth to one-fifth of that required for conventional metalworking lubricants, thus a great materials savings is achieved with the lubricant of the present invention. Most importantly, the high melt point of the solid film layer that results on the metal substrate makes it possible to use the composition of the present invention in metal-forming operations where temperatures can rise to levels in excess of the melt points of prior art prelubes. The high melt points of the solid film prelube layers resulting from use of the compositions of the present invention are attained without any appreciable degradation in other desirable functional characteristics of the prelube layers.

The lubricant emulsion can easily be applied as is to a metal substrate, non-ferrous or ferrous, via a roll-coater system by one of two methods. Either the lubricant is warmed and applied to a warm metal substrate, or the lubricant is applied at ambient temperature to a metal substrate at ambient temperature. Depending upon the choice of application, a series of warm ovens may be necessary to evaporate the aqueous carrier, reflow the coating following drying, or both. Under normal application conditions, the significant water component of the present compositions readily evaporates leaving a dry, solid film prelube coating on the metal substrate.

As mentioned earlier, the properties of corrosion prevention and forming lubrication capabilities of the solid film prelube emulsion invention for metal are both highly dependent to a significant degree upon the uniformity of the lubricant coating film on the metal substrate. Performance properties of prelube compositions, especially solid film prelubes, are greatly enhanced and advanced by the presence of a uniform and homogenous coating on the metal substrate until such time during which the coating is removed by some form of cleaning operation. The lubricant layer, resulting from application of the compositions of the present invention, offers this important performance advantage in that it is a solid, consistent, and continuous coating which is retained on the metal substrate until such time removability is called for.

The compositions of the present invention are particularly useful for applying a solid film prelube layer for applications on steel, aluminum, brass, copper and other metal substrates in the automotive, appliance, beverage container, and general manufacturing industries. The lubricant has been found compatible with conventional processing methods used in the automotive and appliance industries, and is compatible with electro-coated paint primers and with adhesives and welding used commercially in the automotive industry. In addition, the composition has been found to be compatible with applications in the beverage container industry where it is critical that the lubricated metal surface, such as aluminum used in beverage cans, be free of any residual contaminants. Such contamination from lubricating or other working treatments is measured in terms of an equivalent linoleic acid content. The compositions of the present invention have been found to leave equivalent linoleic acid levels on treated aluminum of less than 50 parts per million (ppm). This result is well below the accepted industry maximum, 500 ppm, for acceptable linoleic acid content.

The lubricant composition, according to the present invention, may successfully be coated onto a variety of metal substrates by passing the substrate through a liquid bath from ambient to elevated temperatures, applying the lubricant by rollcoating, removing the excess by squeegy and then evaporating the water from the coating film. Such lubricant may also be applied in any manner suitable for a viscous liquid including brushing, dip-coating or electrostatic spray.

For commercial applications, the lubricant composition of the present invention may be applied via an electrostatic spray, by dipping the metal through a bath containing the compositions, or by running the metal through a rollcoater. A series of moving coating rolls will apply the composition to a moving metal strip (from coating pans containing the composition) as the strip runs between the rolls. A variety of coating variables including metal strip speed, speed of the coating rolls, size, number and composition of the rolls, composition viscosity and dilution, pressure of the rolls on the metal strip, gap sizes between the metal strip and coating rolls and temperature of the metal strip and solid film prelube composition all will determine the final coating weights applied. The lubricants of the invention are usually applied to a metal substrate, such as a coil, blank or wire, at a rate of 20–500 mg/ft$^2$.

The following examples are presented to describe preferred embodiments and utilities of the present invention and are not meant to limit the present invention unless otherwise stated in the claims appended hereto.

EXAMPLE 1

Preparation of Composition A

A composition of the present invention, designated as Composition A, comprising an aqueous emulsion of an hydroxystearamide wax, the composition capable of forming a dry, solid lubricating layer of uniform thickness upon application to a metal substrate, was prepared as follows:

Two blending vessels equipped with mechanical means of heating and stirring were used. Both vessels were well insulated to allow for both uniform heating and cooling.

The following ingredients were added and mixed in the first vessel: 5.5 wgt % Paracin 220®, an ethylene glycol monohydroxy stearate available from CasChem, Inc.; 2.0 wgt % Century 1220®, a double pressed stearic acid available from Union Camp Chemicals; 0.12 wgt % A-C 5120®, an ethylene acrylic acid copolymer available from Allied Signal Corporation; 0.06 wgt % Univox 1494®, a hindered phenol antioxidant available from Rhone-Poulenc, 1.0 wgt % MONACOR 39®, an oleic acid imidazoline-aspartic acid diester blend available from Mona Industries, Inc., and 0.3 wgt % Uniflex 188™, a tridecyl stearate available from Union Camp Corporation. The weight percentages are based on the total weight of the final composition. The mixture was heated to 195–200° F. and blended at moderate speed until the ingredients melted and the mixture appeared homogeneous, with no undissolved solids.

Simultaneously, into a second vessel, 30.0 wgt % deionized water was added and heated with moderate agitation to 190–195° F., and maintained in the closed reaction vessel. To the second vessel at 190–195° F., 0.1 wgt % of Dowicil 75®, 1-(3-chloroallyl)-3,5,7-triazo-1-1-azoniaadamantane chloride (commercially available from Dow Chemical Company), was added, and the resulting mixture was stirred until clear. Next, 1.0 wgt % AMP-95®, 2-amino-2-methyl-1-propanol (available from ANGUS Chemical Company), was added to the heated mixture in the second vessel and stirred until a clear, homogeneous solution was obtained. The aqueous mixture was maintained at 190–195° F.

As the fatty acid amide mixture was moderately agitated and maintained at 190–195° F. in the first vessel, the aqueous mixture from the second vessel was added slowly, to avoid splashing, into the vortex of the fatty acid amide mixture. A tannish-white viscous emulsion formed as the aqueous mixture was added. The emulsion was mixed without heating, and the final aqueous portion, at ambient temperature, of about 62 wgt % was added directly into the vortex of the partially formed emulsion with continuous agitation at a rate sufficient to overcome the increased viscosity of the resulting composition. Agitation is continued until the final composition is formed, as characterized by a dull white and homogeneous appearance, and the temperature decreases to 100° F. The final composition had a mild odor, a pH of 8.2–9.5, a refractive index of 1.346–1.348 (at 77° F.), a Brookfield viscosity (#3 spindle at 6.0 rpm) of 5,000–20,000 cps (at 77° F.), and a density of 8.2 to 8.3 pounds/gallon (at 77° F.). The resulting composition had a solids content, as determined from a 2-gram sample at 225° F. for 60 minutes, of 7.5–8.5%.

EXAMPLE 2

Preparation of Composition B

A lubricant composition of the present invention, designated Composition B, was prepared according to the procedure described in Example 1, resulting in the following final composition:

| Component | Composition (wgt %) |
|---|---|
| Paracin 220 ™ | 4.50 |
| Century 1220 ™ | 2.00 |
| A-C 540 ™ | 2.00 |
| Univox 1494 ™ | 0.06 |
| Smithol 50 ™ | 1.30 |
| Dowicil-75 ™ | 0.10 |
| AMP-95 ® | 0.80 |
| deionized water | 89.24 |

[1]ethylene/acrylic acid copolymer with Mettler drop point of 226° F.; hardness of 2.0 dmm; density of 0.93 g/cc; a Brookfield viscosity of 500 cps @ 140° C.; and an acid number of 40 mg KOH/g.
[2]adipic acid ester

EXAMPLE 3

Coating of Test Panels

The solid film prelube emulsion compositions prepared in Examples 1 and 2 were coated onto various types of steel panels by several different methods. Test panels are usually purchased from a major panel manufacturer such as Advanced Coating Technologies, Inc. of Hillsdale, Mich. Test panels are usually 3"×6" or 4"×6" in size. A variety of specific steel substrates were used, as indicated in subsequent examples.

Test panels of several specific aluminum alloys including 3004, 5052 and 5182 were also coated with the prelube compositions described in Examples 1 and 2 by several different methods. These alloys were obtained from several major aluminum mills including Aluminum Company of America (Alcoa) and Reynolds Metals Company.

Before the coating process, all test panels are cleaned with hexane and xylene. When dry, the panel mass was recorded to 0.0001 gram on an analytical balance.

Specific coating weights can be achieved by using a variety of sizes of standard draw bars (sizes #2.5–#20, available from Paul Gardner Co., Inc.) and various aqueous dilutions of the solid film prelube compositions prepared in Examples 1 and 2. A composition can be applied to aluminum or steel panels by one of two methods:

Method 1:

Applying the lubricant composition (or dilution thereof) via a metal draw bar of a specific size. A uniform film is applied to a test panel at ambient temperature and allowed to dry for sixty minutes at ambient temperatures to evaporate all water from the lubricant composition allowing the film to set. Coating panels may then be placed on a warm hot plate with an accurate surface thermometer present. Panels are placed on the hot plate surface only momentarily, allowing for sufficient warming to 210° F. to liquify and reflow the dried lubricant composition. Panels are then allowed to cool to ambient temperature.

Method 2:

Applying the lubricant composition (or dilution thereof) via a metal draw bar of a specific size. A uniform film is applied to a test panel whose surface is immediately, just prior to coating, warmed to 210° F. on a hot plate with an accurate surface thermometer present. The aqueous portion of the lubricant composition instantly evaporates and cools the coating, allowing it to set instantaneously. Panels are then allowed to cool to ambient temperature.

During the entire coating process, test panels are always handled by a preparer wearing disposable latex gloves to prevent surface contamination of the metal substrate. The coated panels are then reweighed again on the same scale. The prelube film coating weight is calculated and reported in milligrams per square foot. The coating methods described above are adequate only for small laboratory applications and preparations. Despite the variety of coating methods, the lubricant, according to the present invention, provides a smooth, opaque film (which is hard, yet pliable) on all of the steel and aluminum panels tested, with excellent surface adhesion and wetting properties, providing a homogenous and consistent film coating on the metal substrate.

EXAMPLE 4

Aluminum Ductility and Cup Forming Tests With Compositions A and B

Blanks (see Example 3, supra) of aluminum alloy 5182 were coated with the lubricant composition of Example 1, designated Composition A and with the lubricant composition of Example 2, designated Composition B. Blanks were also coated with a lower-melt point prelube composition that is the subject of co-pending application, Ser. No. 07/906,167, the teachings of which are herein explicitly incorporated by reference. This composition, designated for purposes of this and subsequent Examples as Composition C, was selected in order to enable a direct comparison between the properties of a composition of the present invention with a lubricant composition that produces a solid film prelube layer with the significantly lower melt point of approximately 180° F. Three aluminum blanks were prepared for each composition. Lubricant compositions were applied in order to result in coating weights in the range of 35–45mg/ft$^2$.

The ductility test is used to evaluate the formability of coilcoated aluminum end stock. The predominant mode of deformation encountered during ductility testing is stretching. During testing, the sample material is stretched to a to failure using a ball punch ram. The amount of deformation, as measured by a displacement indicator, is indicative of the forming latitude of the coated stock. Data is generated in two forms: metal deflection of dome in thousandths of an inch, and pounds load on a five-square-inch area. The two forms of data generated correlate very closely. Due to the relative magnitudes of the data generated in each form, results reported in load values are reported in Table I below. Table II reports the statistical summary of the data reported in Table I.

TABLE I

ALUMINUM DUCTILITY TEST RESULTS

| Composition | Failure load range* | Mean* | St. Dev. |
|---|---|---|---|
| A | 400–440 lbs. | 417.8 | 8.79 |
| B | 400–415 lbs. | 407.8 | 4.49 |
| C | 370–410 lbs. | 389.2 | 13.18 |

As can be seen from the data, Compositions A and B (melt point>200° F.) exhibited improved results when compared to Composition C with a significantly lower melt point. Statistical analyses presented in Table II reveal that the differences are statistically significant with a 99% level of confidence utilizing a standard t-test for paired observations.

These results were further substantiated by additional lubrication evaluation performed on blanks of 3004 aluminum alloy which were commercially coated with Compositions A and B at the following coating weights:

| | Coating Weight (mg/ft$^2$) | |
|---|---|---|
| | Top Average | Bottom Average |
| Composition A | 34.20 | 18.05 |
| Composition B | 21.45 | 16.95 |

These blanks were also evaluated in ductility test evaluations. Composition A exhibited a failure and range of 425–480 lbs., a mean of 445.6 pounds and a standard deviation of 18.10 pounds. Composition B exhibited a failure and range of 440–470 lbs., a mean of 457.5 pounds and a standard deviation of 10.89 pounds. Both compositions exhibited better lubrication results versus the original results presented in Table I. This indicates that the commercial application of such compositions further enhances their lubrication performance by the application of uniform and homogenous coatings.

Test samples from the commercial applications were also subjected to Tinius Olsen cup forming evaluations. Composition A successfully produced 14 out of 14 cups and Composition B successfully produced 13 out of 14 cups. The bare aluminum alloy without any coating produced no cups. This is further evidence that both compositions exhibit excellent lubrication on non-ferrous metal substrates.

Table III

EXAMPLE 5

Tinius Olsen Lubrication Evaluations

An additional series of lubrication evaluations were performed on 3004 aluminum alloy utilizing the Tinius Olsen ductomatic sheet metal testing machine. Deep cup drawing evaluations were performed for compositions A, B and C at dried coating weights of 45–55 mg/ft$^2$. The Tinius Olsen tester utilizes a hydraulically powered motor which is directly coupled to a dual, internal drive hydraulic pump. The pumps power three pistons/cylinders which operate solenoid values which apply the clamping force to the coated metal specimen, drive the punch to form the cup, extract the cup and return the tooling to the starting position. 33.8 mm cups were produced with a constant clamping force of 400 lbs. in conjunction with a constant ram stroke (punch speed) of 9 inches/minute. The results are summarized in Table III. For comparative purposes, two commercial fluid based compositions were also evaluated. Both products have been commercially used to manufacture aluminum beverage cans (Composition D is based on a hydrocarbon oil-ester blend and Composition E is based on a synthetic ester).

TABLE III

Tinius Olsen Test Results

| Compositions (ranked from best to worst based on forming ram load mean) | Forming Ram Load (1bf) Three Runs | | |
|---|---|---|---|
| | Mean | Range | Standard Deviation |
| Composition B | 1537.0 | 1527–1541 | 7.11 |
| Composition A | 1578.3 | 1568–1584 | 6.62 |
| Composition C | 1603.7 | 1592–1613 | 9.34 |
| Composition D | 1782.3 | 1780–1785 | 1.73 |
| Composition E | 1784.0 | 1780–1786 | 2.82 |

The results clearly illustrate that Compositions A and B offer significantly better lubrication versus the other three compositions, both fluid based and solid film prelube emulsion, on aluminium. Forming ram load mean values ranged almost 250 lbs with a significant gap exhibited between the solid film prelube emulsions and the fluid based compositions. Compositions A and B offered outstanding lubrication performance on aluminum with the increase in melt point enhancing lubrication performance on the aluminum substrate.

EXAMPLE 6

MOFISS Coefficient of Friction of Composition A

The lubricity of Composition A see Example 1, supra) on an aluminum substrate was determined using the moving-film stationary-sled (MOFISS) method. Data for Composition A is reported along with data for Composition C for comparison purposes.

In MOFISS, a sled having three points of contact with the test surface is moved across an aluminum panel coated with a film of the test lubricant. The test is conducted on a fresh lubricant film and on the same film on other test panels following accelerated aging at 250° F. Identification marks were placed along a short side of the unscored side of the panel. The composition was streaked across the panel about one-third down from the marked edge. The composition was distributed down to the opposite edge with a draw bar and allowed to air dry for one-half hour.

Coefficients of friction were determined on 5182 aluminum alloy end stock provided by Alcoa and values were averaged for three runs. The lubricants were applied at ambient temperature via draw bar resulting in dry coating weights of 35–45 mg/ft$^2$. The data is reported below in Table IV.

TABLE IV

| COEFFICIENTS OF FRICTION | | |
|---|---|---|
| Composition | Ambient | Aged |
| A | 0.061 | 0.063 |
| C | 0.054 | 0.059 |

The solid film prelube composition designated Composition A compared very favorably with the results for Composition C. As reported, the MOFISS coefficients of friction indicate greater lubricity with lower values. As the Table above indicates, solid prelube films deposited from Composition A produced only slightly higher coefficients of friction than those from Composition C. Raising the melt point of such compositions had no deleterious effects upon lubrication performance.

EXAMPLE 7

Waste Treatment Studies of Composition A

Preliminary waste treatment studies were conducted in two aqueous acid cleaners obtainable commercially from Parker-Amchem. The cleaner stream consisted of deionized water containing 2 mL of Ridoline 120E (hydrofluoric acid cleaner) per gallon of water and 12 ml of Ridoline 124C (sulfuric acid cleaner). The cleaner was warmed to 125° F. and contaminated with the two compositions at the levels of 1 and 2 wgt %. The cleaner stream was run uncontaminated as a control.

A standard lab emulsion was prepared and used as a control. The lab emulsion was inoculated with a treatment dosage of 10,000 ppm of each cleaner stream. Mixtures were then treated with 350 ppm of a commercially available cationic polymer (Nalco 7722), and 0.35 mL of an alum solutions. Nalco 7722 is a cationic polymer utilized in commercial waste treatment processes for separating solids from their aqueous stream, during the initial stages of treatment. The final treatment process consisted of the addition of a commercially available anionic polymer (Nalco 7763). Nalco 7763 is an anionic polymer utilized in commercial waste treatment processes for the final clarification of the aqueous stream prior to discharge. COD values were then run on the clear bottom layers that remained. The results are provided below.

TABLE II

| STATISTICAL ANALYSIS | | | | | | |
|---|---|---|---|---|---|---|
| Lubricant | Null Hypothesis | Alternative Hypothesis | Mean of Difference (d) | Standard Deviation (SD) | $\frac{\bar{d}-o}{SD/\sqrt{n}}$ | 10% Level of Significance |
| Composition A vs. Composition C | There is no difference betwecn lubrication properties of two lubricants. | There is a significant difference between lubrication properties of two lubricants. | 30.00 | 19.45 | $\frac{30.00-0}{19.45/6\sqrt{7}} = 4.07$ | 4.07 is greater than 3.14. Reject the null hypothesis. Accept the alternative hypothesis. |
| Composition B vs. Composition C | There is no difference between the lubrication properties of two lubricants | There is a significant difference between lubrication properties of two lubricants. | 20.00 | 15.11 | $\frac{20.00-0}{15.11/\sqrt{7}} = 3.49$ | 3.49 is greater than 3.14. Reject the null hypothesis. Accept the alternative hypothesis. |

A recorder, such as a Bausch & Lomb Omnigraphic 2000 recorder, was set to record. The motor speed of the MOFISS apparatus, such as a Sensatec Model 4500, was also set. The marked edge of the panel was engaged between rollers such that the panel was parallel with the drive table and about one-quarter inch away from the drive pulley. The sled bearing was placed down parallel to the edge of the panel and in line with the strain gauge. The sled was connected to the strain gauge. The recorder sweep was started and continued until the panel travelled to within one-quarter inch of the sled. To repeat a determination, the aluminum panel was removed from the rollers and reengaged such that the tracks left by the sled would not intersect previous tracks.

Test panels were also placed in an oven at 250° F. for two hours. The panels were cooled for one hour before additional determinations were made. The edged panels are run both to simulate the effects of heating during drawing operations upon lubricant performance of such compositions and to simulate the long term aging of such compositions during storage. The coefficient of friction was determined by drawing a horizontal line of the graph through the plateau which best represents the average value of the determinations. The distance (cm) of the line from the baseline was determined and multiplied by 0.02 to provide the coefficient of friction.

TABLE V

WASTE TREATMENT DATA

| Solution | Effluent COD (ppm) |
|---|---|
| Lab Emulsion | 230.0 |
| Acid Cleaner Stream | 260.0 |
| Cleaner + 1% A | 280.0 |
| Cleaner + 2% C | 280.0 |
| Cleaner + 1% C | 270.0 |
| Cleaner + 2% C | 270.0 |

The results indicate that Composition A is easily waste treatable and has no negative effects on the treatability of the acid cleaner streams containing it. C.O.D. (chemical oxygen demand) is an indication of the waste treatability of organic matter and represents the level of oxygen required by hot chromic acid during the oxidation of the organic matter. The lower the C.O.D. value, the more treatable a composition is. There were no significant differences between the C.O.D. values for the contaminated cleaner stream versus the control cleaner stream.

EXAMPLE 8

Corrosion Testing for Composition A

The lubricant composition of Example 1 was evaluated to determine whether it would provide the necessary corrosion protection required for aluminum substrates during long periods of storage and transit in varying conditions of humidity and temperature. A Cleveland condensing humidity cabinet was used for corrosion testing. The Cleveland condensing humidity cabinet exposes the metal substrated to the combined adverse conditions of temperature and humidity at an accelerated rate to reduce the time required for testing.

Cleveland cabinet corrosion results were obtained for Composition A and Composition C. Corrosion testing was done on panels of 2008-T4 aluminum alloy from Alcoa and 1100 series aluminum alloy from a major manufacturer of automotive climate control units. Compositions to be tested were applied to test panels by draw bar to achieve a final dry coating weight of 150±5 mg/ft$^2$. Coated panels were aged for 24 hours at ambient conditions prior to corrosion evaluations.

The test chamber consisted of an atmosphere of condensing humidity at 100° F. and 100% relative humidity. Water vapor circulated continually in the chamber, condensing on the coated surfaces of test panels facing the internal chamber of the test cabinet. Water vapor condensed on the coated surfaces of the panels continually washing the panel surfaces. Panels were always handled while wearing disposable latex gloves to prevent surface contamination on the coatings from salts and oils commonly found on human skin. Panels were examined every 24 hours and the test concluded when rust, corrosion or staining appeared over more than five percent of a panel surface. Coated panels were placed at a fifteen degree angle of decline (from vertical) on the chamber. Both Compositions A and C offered over 80 days protection on the 1100 series aluminum alloy exhibiting excellent corrosion protection.

Ford Motor Company test procedure M-14B90A-B(F) 3.2.3. involves exposing coated test panels to conditions of 100° F. and 100% relative humidity in the Cleveland condensing humidity cabinet for 72 hours. General Motors test specification GM9617P involves exposing coated panels for ten consecutive test cycles. Each individual cycle consists of 16 hours exposure in the humidity cabinet at 100° F. and 100% relative humidity followed by eight hours exposure at ambient conditions. Both test procedures are utilized extensively in the automotive industry to gauge the corrosion protection capabilities of compositions applied to both ferrous and non-ferrous surfaces. Both Compositions A and C offered excellent protection in both tests with no staining noted for either composition, on the 2008-T4 aluminum automotive alloy. The increase in melting point from Composition C to Composition A had no negative effect upon the corrosion protection capabilities of such compositions.

Long term corrosion evaluations were also performed on tin plated steel for both Compositions A and C. Tin plated steel is often used in various types of food container packaging where certain aspects of aluminum packaging are not feasible. Compositions A and C were coated on tin plate (Plate No. 30 DGI Stock Type L-Strand Cast T4-CA ATBC 5D) at a dried coating weight of 45–55 mg/ft$^2$. Both compositions provided over 65 days protection in the Cleveland condensing humidity cabinet with no stain or corrosion. These corrosion evaluations also clearly indicate that Composition A offers outstanding corrosion protection.

While the invention is susceptible to various modifications and alternative forms, a specific embodiment thereof has been shown by way of example in the drawings and will herein be described in detail. It should be understood, however, that it is not intended to limit the invention to the particular forms disclosed, but on the contrary, the intention is to cover all modifications, equivalents, and alternatives falling within the spirit and scope of the invention as defined by the appended claims.

Changes can be made in the composition, operation and arrangement of the method of the present invention described herein without departing from the concept and scope of the invention as defined in the following claims:

I claim:

1. A solid film prelubricant composition comprising a fatty acid amide-in-water emulsion including from about 0.10 to about 10.0 wgt % of a hydroxystearamide wax selected from the group consisting of N-(2-hydroxyethyl)-12-hydroxystearamide and N,N'-ethylene-bishydroxystearamide; from about 0.2 to about 7 wgt % emulsifier having an HLB number of at least 8; and from about 85 to about 95 wgt % water.

2. The solid film prelubricant composition of claim 1 further comprising from about 1 to about 10 wgt % imidazoline corrosion inhibitor, from about 0.5 to about 5.0 wgt % ethylene/acrylic acid copolymer, from about 0.01 to about 1.0 wgt % of an antioxidant, and from about 0.5 to about 5.0 wgt % ester.

3. The solid film prelubricant composition of claim 2 further comprising from about 0.01 to about 1.0 wgt % of an antimicrobial agent.

4. A method of lubricating a metal surface comprising the step applying to the metal a coating of the lubricant of claim 1.

5. The method of claim 4 wherein the resulting coating weight ranges from 20 mg/ft$^2$ to 500 mg/ft$^2$.

6. The method of claim 4 wherein the metal is a non-ferrous metal.

7. The method of claim 4 wherein the metal is a ferrous metal.

* * * * *